US006896512B2

(12) United States Patent
Rattner et al.

(10) Patent No.: US 6,896,512 B2
(45) Date of Patent: May 24, 2005

(54) RADIATOR ELEMENT

(75) Inventors: David Rattner, Solebury, PA (US); Joseph A. O'Leary, Ivyland, PA (US)

(73) Assignee: Aztec Machinery Company, Ivyland, PA (US)

( * ) Notice: Subject to any disclaimer, the term of this patent is extended or adjusted under 35 U.S.C. 154(b) by 383 days.

(21) Appl. No.: 10/223,901

(22) Filed: Aug. 20, 2002

(65) Prior Publication Data

US 2003/0054313 A1 Mar. 20, 2003

Related U.S. Application Data

(60) Provisional application No. 60/323,446, filed on Sep. 19, 2001.

(51) Int. Cl.[7] ..... F23D 14/12
(52) U.S. Cl. ..... 431/328; 126/91 R
(58) Field of Search ..... 431/328, 329; 126/91 R, 92 AC

(56) References Cited

U.S. PATENT DOCUMENTS

| | | | | |
|---|---|---|---|---|
| 3,111,396 A | | 11/1963 | Ball | |
| 3,199,573 A | * | 8/1965 | Flynn | 431/329 |
| 3,208,247 A | | 9/1965 | Weil et al. | |
| 3,367,149 A | | 2/1968 | Manske | |
| 3,724,994 A | * | 4/1973 | Desty | 431/328 |
| 3,833,338 A | | 9/1974 | Badrock | |
| 3,870,459 A | * | 3/1975 | Desty et al. | 431/328 |
| 4,480,988 A | | 11/1984 | Okabayashi et al. | |
| 4,533,318 A | | 8/1985 | Buehl | |
| 4,547,148 A | | 10/1985 | Holmer | |
| 4,597,734 A | | 7/1986 | McCausland et al. | |
| 4,599,066 A | * | 7/1986 | Granberg | 431/329 |
| 4,608,012 A | | 8/1986 | Cooper | |
| 4,643,667 A | | 2/1987 | Fleming | |
| 4,889,481 A | | 12/1989 | Morris et al. | |
| 4,900,245 A | | 2/1990 | Ahmady | |
| 4,927,355 A | | 5/1990 | Haire et al. | |
| 5,165,887 A | | 11/1992 | Ahmady | |
| 5,174,744 A | | 12/1992 | Singh | |
| 5,409,375 A | | 4/1995 | Butcher | |
| 5,511,974 A | | 4/1996 | Gordon et al. | |
| 5,989,013 A | * | 11/1999 | Gray | 431/326 |
| 6,114,666 A | * | 9/2000 | Best | 219/411 |
| 6,190,162 B1 | | 2/2001 | Smith et al. | |
| 6,235,665 B1 | * | 5/2001 | Pickrell et al. | 501/9 |

FOREIGN PATENT DOCUMENTS

JP 57027137 A 2/1982

OTHER PUBLICATIONS

Porvair Advanced Materials Inc.—Innovation with Materials Technology, www.porvair.com/mainpam.htm, see section under Product Applications.*

D. Haack, Ken Butcher, T Kim, and T.J. Lu Novel Lightweight Metal Foam Heat Exchangers Technical Report.

* cited by examiner

*Primary Examiner*—Alfred Basichas
(74) *Attorney, Agent, or Firm*—Michael G. Crilly, Esq.

(57) ABSTRACT

The present invention is a radiator element composed of a metal foam for use within a radiant burner. The radiator element is comprised of a homogenous network about a plurality of inter-connected cells thereby forming a gas-permeable metal foam. The homogeneous network may be composed of a metal or metal alloy capable of withstanding combustion temperatures typical of fuel-air reactions and resisting damage produced by flashback. Inter-connected cells include irregular-shaped voids, circular-shaped voids, and combinations thereof.

3 Claims, 3 Drawing Sheets

RADIATOR ELEMENT

CROSS REFERENCE TO RELATED APPLICATIONS

This application claims benefit under 35 U.S.C. 119(e) from U.S. Provisional Application No. 60/323,446 filed on Sep. 19, 2001.

FEDERALLY SPONSORED RESEARCH OR DEVELOPMENT

None.

BACKGROUND OF THE INVENTION

1. Field of the Invention

The present invention generally relates to a radiant burner fueled by a gaseous fuel-oxidant mixture. Specifically, the invention is a radiator element composed of a metal foam for use within a radiant burner.

2. Description of Related Art

Radiant burners are commonly employed for a variety of purposes including heating, drying, and decontamination in such industries as paper manufacture, textile processing, and food preparation.

A typical burner is composed of an inlet attached to a plenum with a radiator element attached to the front of the burner. A baffle and diffuser are provided within the plenum in some embodiments so to optimize the flow of a fuel-oxidant mixture onto the radiator element. Burner efficiency is improved when a majority of the fuel-oxidant mixture combusts within the radiator element.

Ceramic-based radiator elements composed of porous, perforated, honeycomb, and fibrous structures are disclosed in the related arts. Ceramic radiators are heat resistant thereby resistant to heat related fatigue and damage. Furthermore, such radiators effectively communicate thermal energy to surrounding objects. However, ceramic radiators are brittle, easily damaged during handling, and susceptible to flashback induced damage.

Metal-based radiator elements are disclosed within the arts, however limited to screens, nettings, woven and knitted yarns, woven fibers, and mechanically-drilled plates. Screens, nettings, yarns, and fibers are structurally weak and susceptible to deflection and warp when heated to an elevated temperature for a sustained period. Screens, nettings, yarns, fibers, and drilled plates frustrate the combustion of a gaseous fuel-oxidant mixture within the radiator element thereby reducing burner efficiency. Consequently, metal radiators lack the robustness required to resist fatigue and damage and/or fail to efficiently generate and radiate thermal energy.

What is currently required is a robust radiator element that is both mechanically and structurally robust, facilitates the efficient combustion of a gaseous fuel-oxidant mixture, and facilitates the efficient radiation of thermal energy.

BRIEF DESCRIPTION OF THE DRAWINGS

The invention will now be described in more detail, by way of example only, with reference to the accompanying drawings, in which.

REFERENCE NUMERALS

Figure 1:
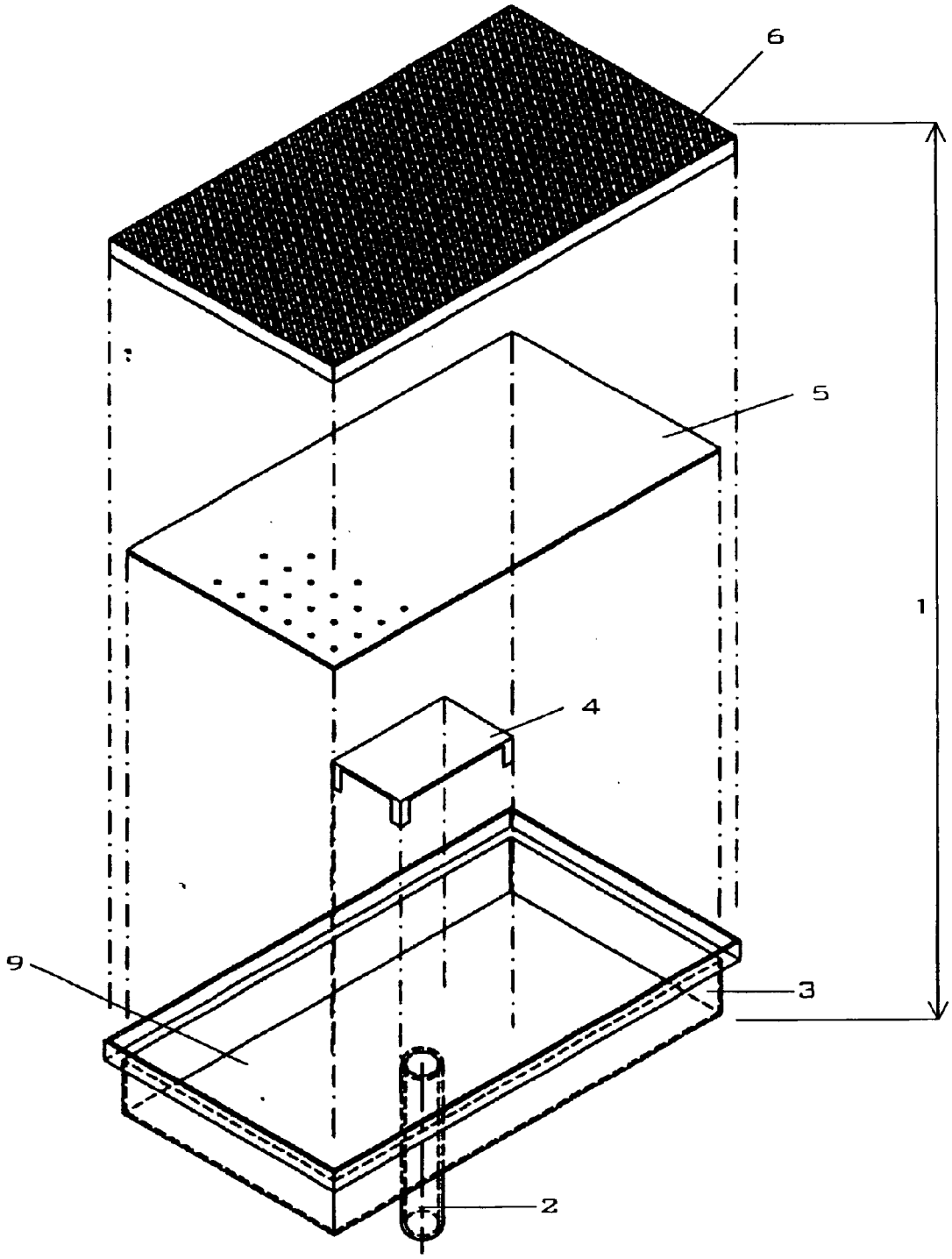
FIG. 1 is an exploded view of a radiant burner showing primary components.

1 Burner
2 Inlet
3 Plenum
4 Baffle element
5 Diffuser element
6 Radiator element
7 Manifold
8 Fuel-oxidant mixture
9 Chamber
10 Front
11 Network
12 Cell

SUMMARY OF INVENTION

An object of the present invention is to provide a radiator element both mechanically and structurally robust to resist fatigue and damage commonly associated with radiant burner applications.

Another object of the present invention is to provide a radiator element facilitating the efficient combustion of a gaseous fuel-oxidant mixture.

A further object of the present invention is to provide a radiator element facilitating the efficient radiation of thermal energy.

The present invention is a radiator element comprised of a homogenous network about a plurality of inter-connected cells thereby forming a gas-permeable metal foam. The homogeneous network may be composed of a metal or metal alloy capable of withstanding combustion temperatures typical of fuel-oxidant reactions and resisting damage produced by flashback. Inter-connected cells include irregular-shaped voids, circular-shaped voids, and combinations thereof. Preferred embodiments of the radiator element are planar shaped having from 15 to 80 pores-per-inch, an average cell diameter from 0.4 to 3 millimeters, and a thickness from 3 to 20 millimeters. However, cylindrical and tubular embodiments are also possible.

Several advantages are noteworthy with the present invention. Metal foam radiators are more resistant to mechanical damage associated with under-fired and over-fired fuel-oxidant mixtures. Metal foam radiators are resistant to heat related fatigue. Metal foam radiators facilitate a more complete combustion within the firing surface. Metal foam radiators are more radiant efficient as a result of a more complete combustion of fuel-oxidant within the radiator. Irregularities along the surface of the metal foam enhance radiation performance particularly in an omni-directional sense.

DESCRIPTION OF THE INVENTION

Figure 2:
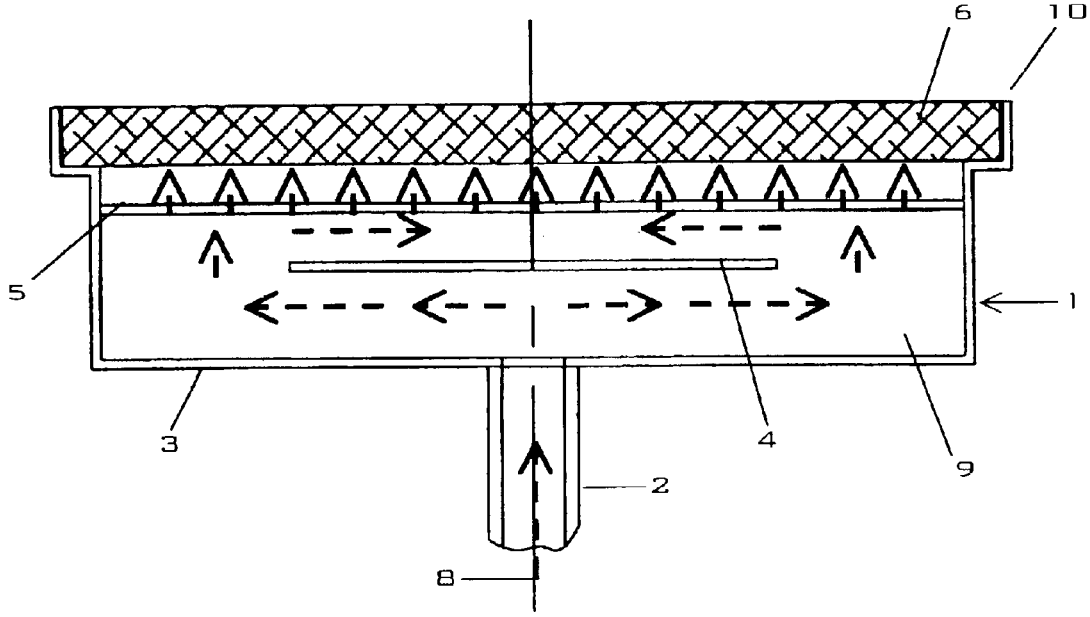
FIG. 2 is a section view of a radiant burner showing fuel-oxidant path.
Figure 3:
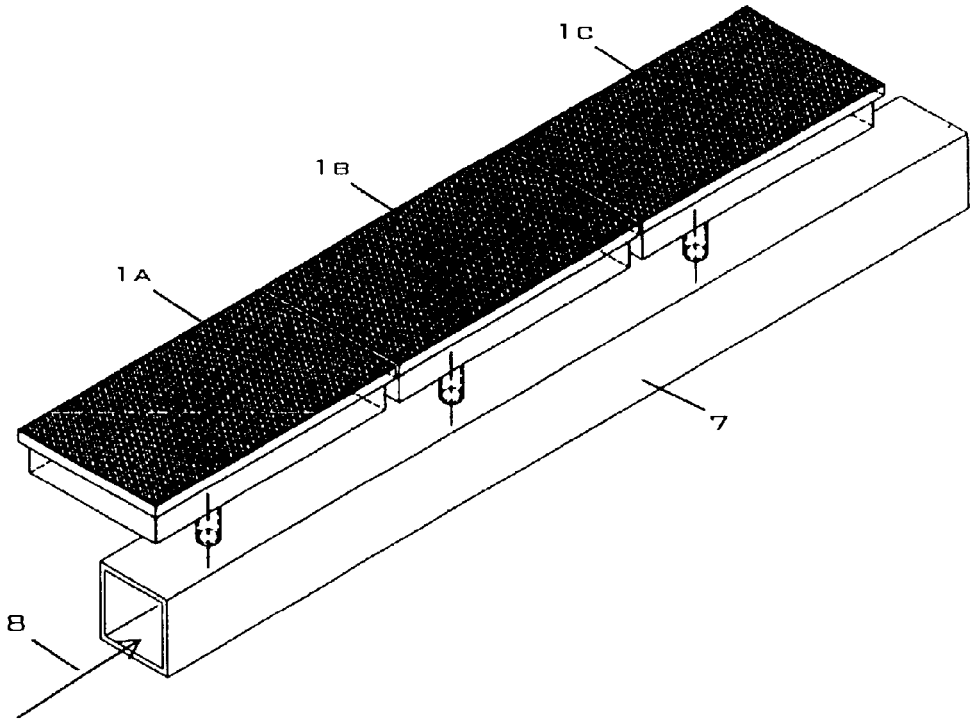
FIG. 3 is a perspective view showing several radiant burners mounted to a common fuel-oxidant source.
Figure 4:
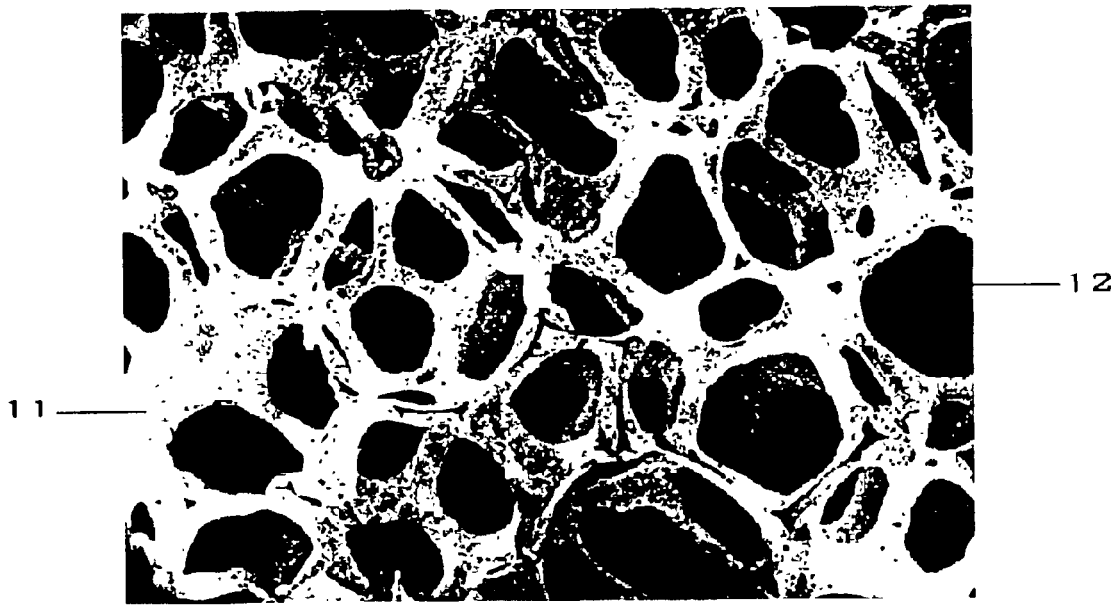
FIG. 4 shows a representative structure for a metal foam radiator.

FIGS. 1, 2, and 3 describe the application of the present invention to a radiant burner 1. While planar applications are shown and described other shapes including but not limited to cylinders and tubes are also possible. FIG. 4 shows an exemplary metal foam embodiment of the present invention.

FIGS. 1 and 2 show a typical burner 1 comprised of an inlet 2, a plenum 3, a baffle element 4, a diffuser element 5, and a radiator element 6. FIG. 3 shows the arrangement of several burners 1*a*, 1*b*, 1*c* along a single manifold 7 in an arrangement typically found in a textile dryer. An igniter device as understood in the art is mounted adjacent to theradiator element 6 as so to initiate combustion of a fuel-oxidant mixture 8.

The plenum 3 is comprised of a five-sided structure having an open front 10 over which a radiator element 6 is fixed. A typical plenum 3 is composed of a metal either cast, molded or formed via methods understood in the art. An inlet 2 is attached to one side of the plenum 3, usually opposite to the radiator element 6, thereby allowing fuel-oxidant mixture 8 to pass into the chamber 9 formed between plenum 3 and radiator element 6. A diffuser element 5 is fixed to the plenum 3 between radiator element 6 and inlet 2. The diffuser element 5 has a plurality of holes along its surface. A baffle element 4 is secured to the plenum 3 between diffuser element 5 and inlet 2. In typical embodiments, baffle element 4 is smaller than diffuser element 5 thereby allowing passage of fuel-oxidant mixture 8 to the diffuser element 5.

Fuel-oxidant mixture 8 is prepared external to the burner 1 in any of a number of well established methods within the art and supplied to the burner 1 under a low-positive pressure. The fuel-oxidant mixture 8 enters the plenum 3 where it is redirected by the baffle element 4 across the plenum 3 thereafter passing to the back surface of the diffuser element 5. The diffuser element 5 is typically a perforated plate with a hole pattern selected to provide a predetermined flow pattern across the extent of the plenum 3. The flow velocity of the fuel-oxidant mixture 8 through the diffuser element 5 is sufficient to prevent flame flashback under most conditions. Radiator element 6 is mounted in close proximity to and parallel with the diffuser element 5.

The radiator element 6 is composed of a foam-like metal structure with voids. Combustion occurs within voids or openings within the foam-like structure thus heating the radiator element 6 to a desired temperature. Energy released during the combustion process is stored within the radiator element 6 and radiated away from the burner 1.

Preferred embodiments of the radiator element 6 are composed of a network 11 about a plurality of inter-connected cells 12, as shown in FIG. 4. The network 11 and cell 12 structure provides a gas-permeable element capable of sustaining combustion. Metal foams sold by Porvair Fuel Cell Technology of Hendersonville, N.C. were sufficiently robust and porous for use within radiant burners 1 applied to textile drying.

The network 11 is composed of either a metal or a metal alloy. Material selection is dependent on the operational temperatures required by the application. Exemplary metals include but are not limited to copper, aluminum, and stainless steel. Exemplary metal alloys include but are not limited to high-temperature iron alloys, one example being Inconel, and Kanthal alloys manufactured by Kanthal AB of Hallstahammar, Sweden. Preferred compositions are resistant to fatigue and damage associated with elevated operating temperatures for sustained periods and should provide sufficient glow to radiate heat. Preferred materials also retain their mechanical strength and robustness to resist flashback at flame temperatures exceeding 900° C. Most preferred embodiments are composed of the high-temperature, iron-based alloy FeCrAlY.

Cells 12 are composed of irregular-shaped voids, circular-shaped voids, as well as combinations and variations thereof. Cells 12 are either ordered in a repeating pattern or randomly disposed within the network 11. While various cell 12 sizes and ranges are possible, cells 12 in the range of 0.4 to 3 millimeters were preferred.

The diffuser element 5 establishes the initial conditions influencing the combustion process. The flow velocity of the fuel-oxidant mixture 8 thru holes along the diffuser element 5 should be greater than the flame propagation velocity to reduce the likelihood of flame flashback into the plenum 3. Conceptually, each hole along the diffuser element 5 is the base of a flame. Hole size is selected to provide stable, complete combustion within the radiator element 6. Hole diameters typically vary between 1 and 5 millimeters and 3 millimeters is generally preferred. The perforation ratio along the diffuser element 5, representing the ratio of total hole area to total element area, is selected to assure proper flow velocity by the fuel-oxidant mixture 8. Perforation ratios typically vary between 2% and 10% where 3% is generally preferred.

Porosity, namely pores-per-inch (PPI) value, and thickness of the radiator element 6 influence the operational usefulness of the design. The radiator element 6 must be sufficiently obstructive to stabilize and complete combustion yet sufficiently unobstructive to allow the fuel-oxidant mixture 8 to flow through the radiator element 6 and radiate thermal energy. In many applications, PPI values range from 15 to 80 with preferred embodiments having a value of approximately 60. Thickness of the radiator element 6 in the range of 3 to 20 millimeters were found to perform adequately in many textile applications with preferred embodiments having a thickness of around 10 millimeters.

The description above indicates that a great degree of flexibility is offered in terms of the apparatus. Although the present invention has been described in considerable detail with reference to certain preferred versions thereof, other versions are possible. Therefore, the spirit and scope of the appended claims should not be limited to the description of the preferred versions contained herein.

What is claimed is:

1. A radiator element comprising a gas-permeable metal foam composed of a homogeneous network with a plurality of inter-connected cells, said gas-permeable metal foam attached to a plenum within a radiant burner, said gas-permeable metal foam supporting combustion of a fuel-oxidant mixture within said inter-connected cells, said gas-permeable metal foam communicating heat away from said homogeneous network in a radiant fashion, said gas-permeable metal foam resistant to mechanical damage associated with flashback and heat related fatigue.

2. The radiator element of claim 1, wherein said homogeneous network is a high-temperature alloy.

3. The radiator element of claim 1, wherein said homogeneous network is stainless steel, Inconel, FeCrAlY, or Kanthal alloy.

* * * * *

UNITED STATES PATENT AND TRADEMARK OFFICE

CERTIFICATE OF CORRECTION

PATENT NO. : 6,896,512 B2
DATED : May 24, 2005
INVENTOR(S) : Rattner et al.

It is certified that error appears in the above-identified patent and that said Letters Patent is hereby corrected as shown below:

Title page,
Item [73], Assignee, delete "Aztec Machinery Company, Ivyland, PA (US)" insert -- Solebury Technical, Incorporated, Solebury, PA (USA) --

Column 2,
Line 66, delete "theradiator" insert -- the radiator --

Signed and Sealed this

Twelfth Day of July, 2005

JON W. DUDAS
*Director of the United States Patent and Trademark Office*